US007377394B2

(12) United States Patent
Buss

(10) Patent No.: US 7,377,394 B2
(45) Date of Patent: May 27, 2008

(54) BLISTER PACK HAVING A TETHER ULTRASONICALLY WELDED THROUGH A LIDDING AND INTO A RIB

(75) Inventor: Michael Adam Buss, Breinigsville, PA (US)

(73) Assignee: Fisher Clinical Services, Allentown, PA (US)

( * ) Notice: Subject to any disclaimer, the term of this patent is extended or adjusted under 35 U.S.C. 154(b) by 131 days.

(21) Appl. No.: 10/895,667

(22) Filed: Jul. 20, 2004

(65) Prior Publication Data

US 2006/0016718 A1 Jan. 26, 2006

(51) Int. Cl.
*B65D 83/04* (2006.01)
*B65D 73/00* (2006.01)
*B65D 41/00* (2006.01)

(52) U.S. Cl. ..... 206/531; 206/461; 206/538; 220/359.1

(58) Field of Classification Search ..... 206/531–532, 206/534–534.1, 538–539, 461–470, 484–484.2; 220/359.1, 359.2, 359.4
See application file for complete search history.

(56) References Cited

U.S. PATENT DOCUMENTS 2,652,149 A 9/1953 O'Meara
3,381,808 A 5/1968 McGraw, II
3,630,346 A 12/1971 Burnside
3,676,159 A * 7/1972 Fallowfield ..... 206/471
3,690,903 A * 9/1972 Thomka ..... 206/461
3,809,221 A 5/1974 Compere
3,835,995 A 9/1974 Haines
3,888,350 A 6/1975 Horvath
3,921,805 A 11/1975 Compere
3,931,885 A 1/1976 Nahill et al.
3,941,248 A 3/1976 Moser et al.
4,113,098 A 9/1978 Howard
4,125,190 A 11/1978 Davie, Jr. et al.
4,126,224 A 11/1978 Laauwe
4,192,422 A 3/1980 Kotyuk
4,211,329 A 7/1980 Braverman
4,294,361 A 10/1981 Margulies et al.

(Continued)

FOREIGN PATENT DOCUMENTS

EP 0 393 942 A 10/1990

(Continued)

OTHER PUBLICATIONS

Key-Oak Child Resistant Senior Friendly Blister Card, Indication of Patent Pending. Keystone Folding Box Co., Newark, NJ.

(Continued)

*Primary Examiner*—Bryon P Gehman
(74) *Attorney, Agent, or Firm*—Workman Nydegger

(57) ABSTRACT

A blister pack includes a blister card having one or more cavities and a rib formed in the blister card, the rib having an inner surface, and a tether coupled to the inner surface of the rib. Ultrasonically welding the tether within the inner surface of the structural rib provides for an increased bond surface area and increased strength of the couple without sacrificing valuable surface area on the blister pack.

25 Claims, 11 Drawing Sheets

U.S. PATENT DOCUMENTS 4,340,141 A 7/1982 Fischer
4,364,488 A 12/1982 Anjou
4,398,634 A 8/1983 McClosky
4,401,210 A 8/1983 Anjou
4,506,789 A 3/1985 Dlugosz
4,537,312 A 8/1985 Intini
4,553,670 A 11/1985 Collens
4,561,544 A 12/1985 Reeve
4,567,986 A 2/1986 Eastwood
4,669,613 A 6/1987 Collens
4,844,284 A 7/1989 Drozd et al.
4,884,693 A 12/1989 Brutsch
4,974,729 A 12/1990 Steinnagel
4,988,004 A 1/1991 Intini
5,046,618 A 9/1991 Wood
5,074,416 A * 12/1991 Hustad ..... 206/471
5,080,222 A 1/1992 McNary
5,082,137 A 1/1992 Weinstein
5,088,603 A 2/1992 Kirkpatrick
5,091,261 A * 2/1992 Casey et al. ..... 206/461
5,172,182 A 12/1992 Wharton et al.
5,242,055 A 9/1993 Pora
5,275,291 A 1/1994 Sledge
5,310,060 A 5/1994 Bitner et al.
5,323,907 A 6/1994 Kalvelage
5,325,968 A 7/1994 Sowden
5,329,750 A 7/1994 Bagley et al.
5,339,960 A 8/1994 Price
5,346,069 A 9/1994 Intini
5,437,371 A 8/1995 Lataix
5,469,968 A 11/1995 Matthews et al.
5,489,025 A 2/1996 Romick
5,511,665 A 4/1996 Dressel et al.
5,551,567 A 9/1996 Malone et al.
5,755,462 A 5/1998 Lupi
5,758,774 A 6/1998 Leblong
5,775,505 A 7/1998 Vasquez et al.
5,785,180 A 7/1998 Dressel et al.
5,833,072 A 11/1998 Lambelet, Jr.
5,862,915 A 1/1999 Plezia et al.
5,878,887 A 3/1999 Parker et al.
5,878,888 A 3/1999 Faughey et al.
5,894,930 A 4/1999 Faughey et al.
5,908,208 A 6/1999 Lapsker
5,915,559 A 6/1999 Hulick et al.
5,927,500 A 7/1999 Godfrey et al.
5,944,191 A 8/1999 Ray et al.
5,983,608 A * 11/1999 Wu et al. ..... 220/359.1
6,021,901 A 2/2000 Wolfe
6,024,222 A 2/2000 Friberg et al.
6,036,016 A 3/2000 Arnold
6,047,829 A 4/2000 Johnstone et al.
6,161,699 A 12/2000 Gartland
6,230,894 B1 5/2001 Danville
6,273,260 B1 8/2001 ColDepietro et al.
6,338,407 B2 1/2002 Danville
6,349,831 B1 2/2002 Buss
6,375,956 B1 4/2002 Hermelin et al.
6,394,275 B1 5/2002 Paliotta et al.
6,401,926 B1 * 6/2002 Lo ..... 206/531
6,412,636 B1 7/2002 Jones et al.
6,422,391 B1 7/2002 Swartz
6,491,211 B1 12/2002 Evans et al.
6,543,209 B1 4/2003 Siegel et al.
6,571,790 B1 6/2003 Weinstein
D478,810 S 8/2003 Wilson
6,681,935 B1 1/2004 Lewis
6,708,825 B2 3/2004 Filion et al.
6,726,015 B2 4/2004 Hulick
6,752,272 B2 6/2004 Jones et al.
6,889,825 B2 * 5/2005 Ichikawa et al. ..... 220/359.1
6,951,282 B2 10/2005 Jones
2003/0062287 A1 4/2003 Gelardi et al.
2004/0026293 A1 * 2/2004 Hughes ..... 206/538
2004/0050748 A1 3/2004 Ehrlund
2004/0108240 A1 6/2004 Ragot
2004/0182738 A1 9/2004 Williams-Hartman
2004/0182739 A1 9/2004 Williams-Hartman
2004/0188311 A1 9/2004 Paliotta et al.
2004/0188312 A1 9/2004 Stepowany
2004/0188315 A1 9/2004 Morita et al.
2005/0035023 A1 2/2005 Breu et al.
2005/0087474 A1 4/2005 Killinger
2005/0145532 A1 7/2005 Kancsar et al.
2005/0230282 A1 10/2005 Lapsker
2005/0274644 A1 12/2005 Williams-Hartman

FOREIGN PATENT DOCUMENTS

EP 1 293 436 A 3/2003
FR 2 764 274 A 12/1998
WO WO 00/15518 A 3/2000
WO WO 02/18229 A1 3/2002

OTHER PUBLICATIONS

International Search Report for PCT/US2005/025359 issued Nov. 15, 2005.

* cited by examiner

BLISTER PACK HAVING A TETHER ULTRASONICALLY WELDED THROUGH A LIDDING AND INTO A RIB

BACKGROUND

It is generally known that pharmaceutical products may be distributed in a variety of forms. Single dose pharmaceutical products are commonly available in tablets, lozenges, capsules, and the like. It is also known that some pharmaceutical products can pose a health risk to young children who are unable to recognize the risks of ingesting such products.

Accordingly, recent efforts have been made to provide child-resistant pharmaceutical product packaging that prevents a child from accessing the product, yet provides access to adults. By forming child resistant pharmaceutical packaging, accidents caused by a child ingesting a pharmaceutical product are greatly reduced.

One existing method for forming child resistant pharmaceutical packaging is illustrated in FIG. 1. As shown, a prior art child resistant package (100) includes a pharmaceutical blister pack (140) including a plurality of pharmaceutical blisters (145) formed therein. The pharmaceutical blisters (145) are configured to house a pharmaceutical product. The pharmaceutical blister pack (140) is then coupled via a tether keeper (150) to a tether lip (130) portion of a tether (120). In general, the tether keeper (150) is formed with a pair of posts (160) that mate with complementary bosses (165) formed in the housing (114), thereby coupling the tether keeper to the housing.

In turn, the tether (120) is then coupled to a child resistant shell (110) having both a housing (114) and a cover (112). FIG. 2 further illustrates an assembled child resistant package (100). As illustrated, the tether (120) and the coupled pharmaceutical blister pack (140) may be slideably inserted into the housing (114) of the child resistant shell (110). Once inserted into the child resistant shell (110), the housing (114) and the cover (112) may be matingly joined around the pharmaceutical blister pack (140), thereby defining at least a partial enclosure to protect the pharmaceuticals contained therein from child use. Further explanation of a child-resistant product package can be found in U.S. Pat. No. 6,349,831, the disclosure of which is hereby incorporated by reference.

As illustrated in FIGS. 1 and 2, a number of known pharmaceutical packaging methods use a specially designed package coupled to a pharmaceutical blister pack (140) via a tether. Additionally, tethers may be used to couple any number of packaging types to a blister pack (140). Additional packaging that may be coupled to a blister pack (140) via a tether may include protective packaging, packaging containing instructions for use and care of the blister-pack, or packaging designed to increase the aesthetic appeal of the blister pack.

Traditional methods for joining the pharmaceutical blister pack (140) to a tether (120) include using an ultrasonic weld system to form a flat weld between the blister surface of the pharmaceutical blister pack (140) and the tether lip (130). While the traditional flat weld is sufficient to initially couple the pharmaceutical blister pack (140) to the tether lip (130), very light bending of the ultrasonically welded interface typically causes both failure and separation of the union, often resulting in the accidental removal of the pharmaceutical blister pack (140) from the tether. Once the pharmaceutical blister pack (140) is separated from the tether, the child-resistant qualities of the child-resistant shell (110), or other non-child resistant qualities offered by the tether, are eliminated.

While additional methods for joining a tether to a pharmaceutical blister pack (140) exist, forming an effective joint between a pharmaceutical blister pack and a tether lip (130) is limited to joining methods that only use the outer portion of the blister pack. That is, very limited space is available for joining on the pharmaceutical blister pack (140) because a majority of the available area is populated by pharmaceutical blisters (145).

SUMMARY

A blister pack includes a blister card having one or more cavities and a rib formed in the blister card, the rib having an inner surface, and a tether coupled to the inner surface of the rib.

Moreover, a method for ultrasonically attaching a blister card to a tether wherein the blister card has at least one stiffening rib formed at a peripheral edge of the blister card includes positioning the blister card in an anvil on an ultrasonic welder having an ultrasonic horn and a horn extrusion formed on the ultrasonic horn such that the stiffening rib faces in a concave orientation with respect to the ultrasonic horn, superposing an edge of the tether over the concave stiffening rib of the blister card, lowering the ultrasonic horn onto the tether superposed over the rib, forcing the tether into the stiffening rib with the horn extrusion, and energizing the ultrasonic horn to ultrasonically weld the tether into the concave portion of the stiffening rib.

BRIEF DESCRIPTION OF THE DRAWINGS

The accompanying drawings illustrate various embodiments of the present system and method and are a part of the specification. The illustrated embodiments are merely examples of the present system and method and do not limit the scope thereof.

Throughout the drawings, identical reference numbers designate similar, but not necessarily identical, elements.

DETAILED DESCRIPTION

Figure 1:
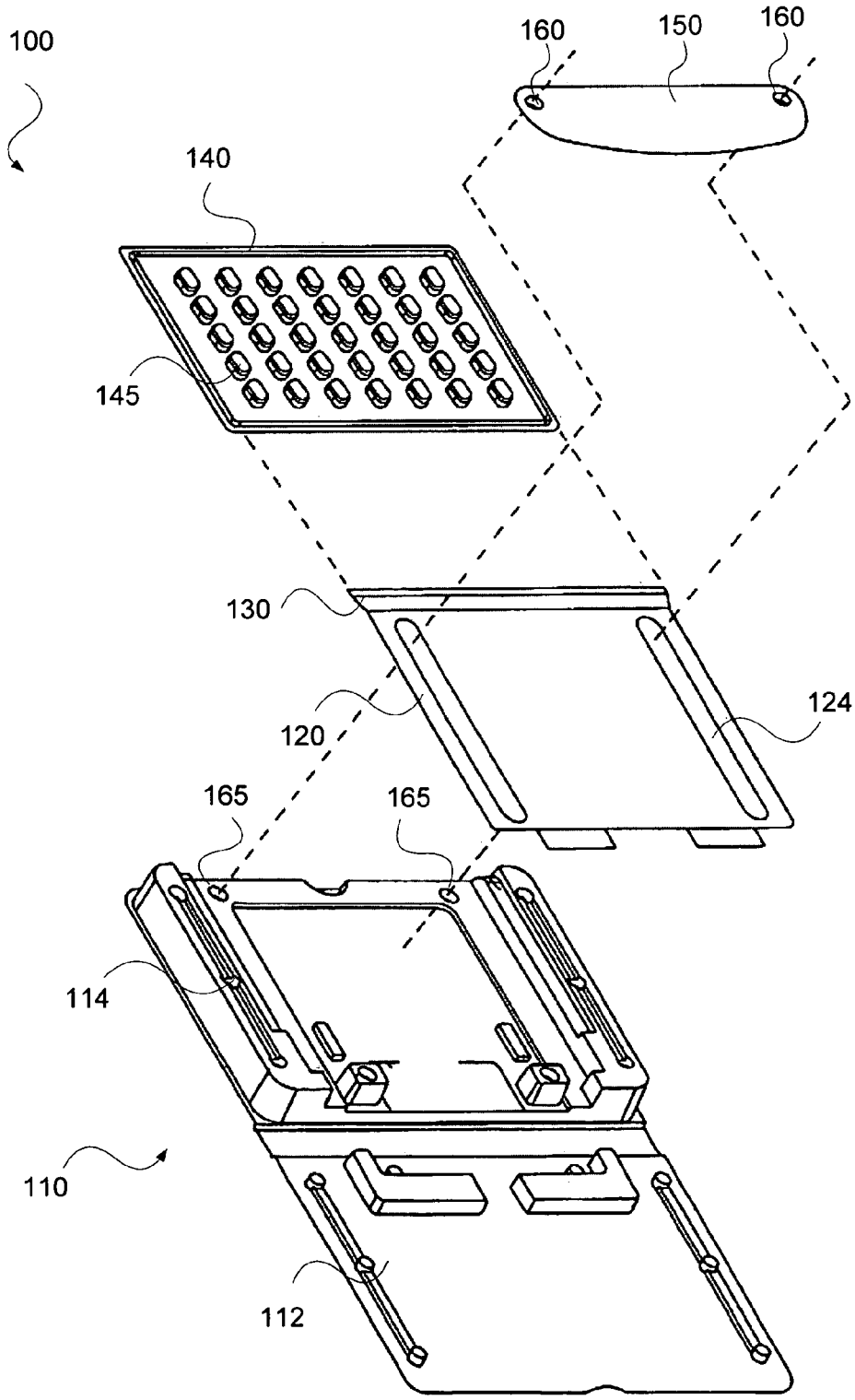
Fig. 1 Prior Art
FIG. 1 is an exploded perspective view illustrating the components of a traditional child-resistant product package.
Figure 2:
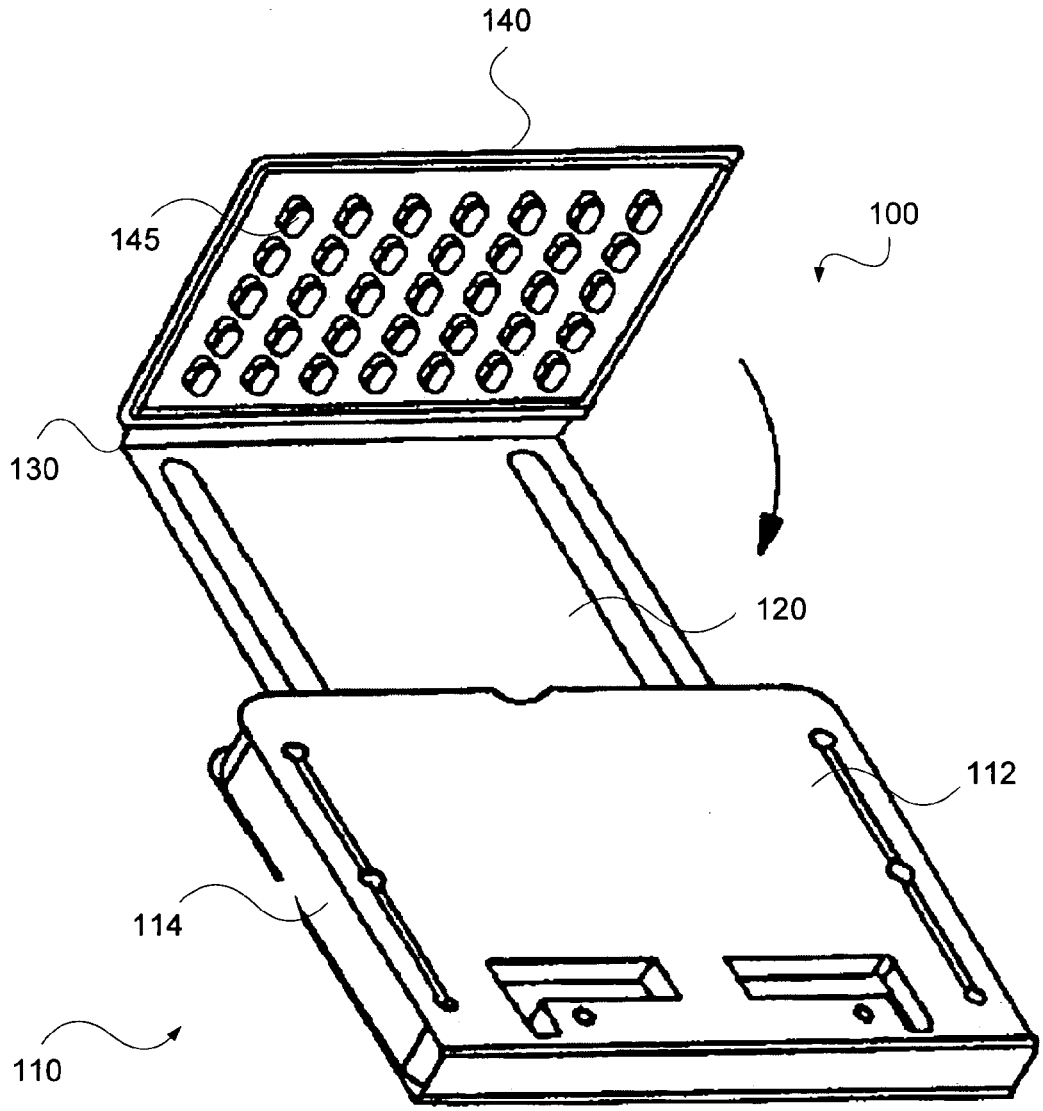
Fig. 2 Prior Art
FIG. 2 is a perspective view illustrating an assembled child-resistant product package.

A number of exemplary systems and methods for securely coupling a pharmaceutical housing, such as a blister pack, to a tether are described herein. More specifically, the present exemplary systems and methods provide for joining a pharmaceutical carrier to a tether such that the joint is not easily fatigued by bending. Additionally, the present systems and methods join the pharmaceutical carrier to a tether without sacrificing valuable surface area on the pharmaceutical carrier. The exemplary systems and methods will first be described in the context of an ultrasonic welding system followed by a detailed explanation of an exemplary method for ultrasonically welding a tether to the pharmaceutical carrier.

As used in this specification and in the appended claims, the term "pharmaceutical" is meant to be understood broadly as any medicinal structure or edible casing configured to house a substance related to a medicinal treatment. The medicinal structure can include an active ingredient for an approved medical treatment or a medical treatment being evaluated or the medicinal structure can include a placebo ingredient used during clinical trials to compare against the medical treatment being evaluated (i.e., a placebo capsule). The term "pharmaceutical housing" is meant to be understood broadly as referring to any structural configuration aimed at securing and/or protecting a pharmaceutical dosage. In some embodiments, the pharmaceutical housing may include a single or multiple pharmaceutical dosages. The present system and method may be used to securely couple the pharmaceutical housing to a tether, which may then be coupled to a child resistant package, to an instruction sheet, to an aesthetic enhancing card, or to any other tether, as will be explained in detail below.

The term "tether" is meant to be understood broadly both in the present specification and in the appended claims as any material or extrusion configured to be coupled to a pharmaceutical housing. Accordingly, a tether may be a simple tab extruding from a pharmaceutical housing, a complex coupling system, a simple aesthetic enhancing card, a display facilitating card, an instruction card, and the like.

As used in the present specification, and the appended claims, the term "ultrasonic welding" or "ultrasonic weld" is meant to be understood as referring to any joining method that uses ultrasonic vibrations to cause plastic or pliable deformation at work piece interfaces, thereby producing an effective solid-state bond. Ultrasonically welding a plurality of parts may include holding the parts to be joined under pressure and subjecting the part interfaces to ultrasonic vibrations to soften or melt the parts at the interface.

In the following description, for purposes of explanation, numerous specific details are set forth to provide a thorough understanding of the present systems and methods for ultrasonically welding a tether to a pharmaceutical housing. It will be apparent, however, to one skilled in the art, that the present systems and processes may be practiced without these specific details. Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

Figure 3:
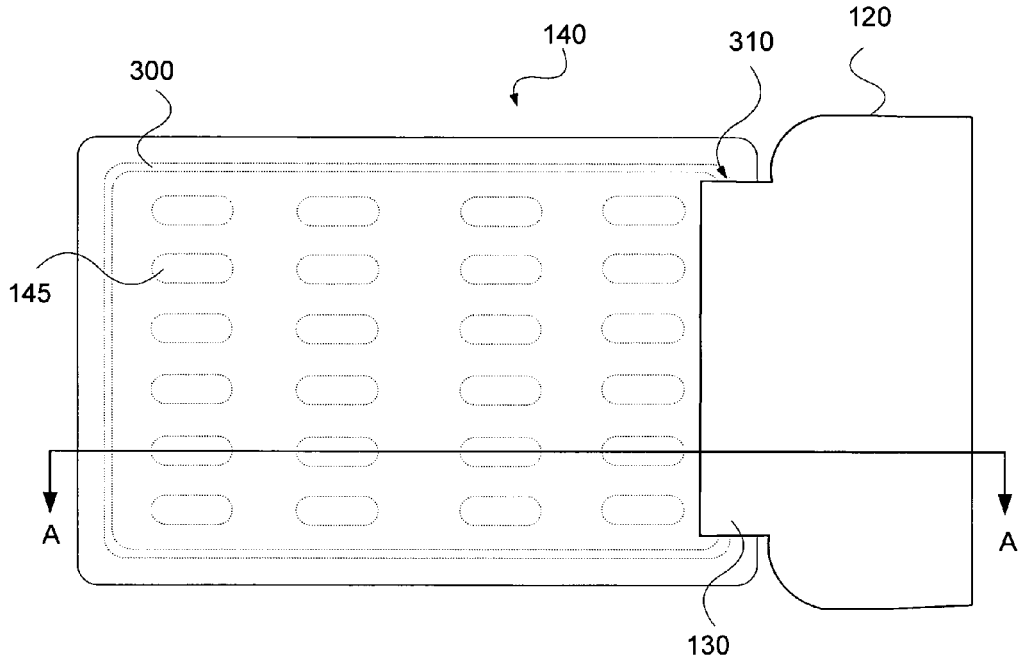
FIG. 3 is a bottom view illustrating the geometry of a pharmaceutical blister pack, according to one exemplary embodiment.

Turning now to the exemplary structure of the present system, FIG. 3 illustrates a bottom view of a pharmaceutical housing in the form of a blister pack (140), according to one exemplary embodiment. As illustrated in FIG. 3, the pharmaceutical blister pack (140) includes a number of pharmaceutical blisters (145) configured to hold a quantity of a pharmaceutical product such as a plurality of tablets or the like, and has a structure that is generally known in the art. Also shown in FIG. 3, the outline of a structural rib (300) is formed on the outer edge of the pharmaceutical blister pack (140) to increase structural integrity of the pharmaceutical blister pack (140) by resisting curling or bending. Additionally, a tether lip (130) is positioned adjacent to the pharmaceutical blister pack (140). As shown, the pharmaceutical blister pack (140) is coupled to the tether lip (130) at a joining interface (310). The joining interface (310) allows the tether lip (130) to be coupled to the structural rib (300) of the pharmaceutical blister pack (140) while providing for a junction with increased surface area and strength. The structure of the pharmaceutical blister pack (140) and its operation will now be discussed in further detail below, followed by a discussion of the joining interface (310) between the pharmaceutical blister pack (140) and the tether lip (130).

Figure 4:
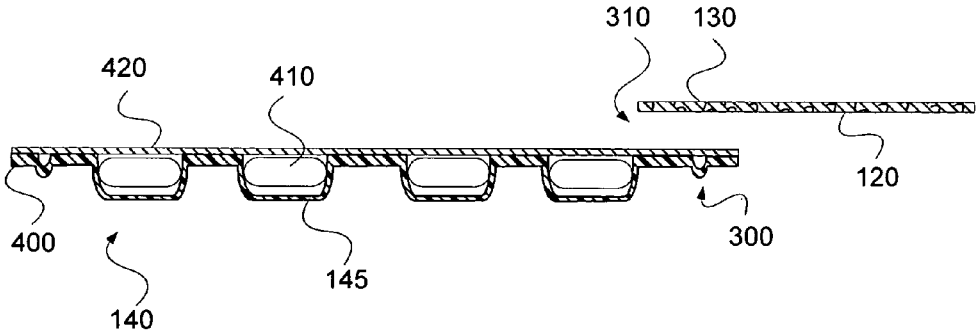
FIG. 4 is a cross-sectional side view illustrating the exemplary pharmaceutical pack illustrated in FIG. 3, sectioned along the line AA.

FIG. 4 is a cross-sectional view illustrating the pharmaceutical blister pack (140) of FIG. 3, sectioned along the line A-A. As shown in FIG. 4, the pharmaceutical blister pack (140) is generally operable to hold a quantity of pharmaceutical products (410), such as a plurality of tablets, capsules, or the like, and has a structure that is generally known in the art. Accordingly, the pharmaceutical blister pack (140) is shown generally as having a sheet of thermoplastic blister material (400) including a plurality of resilient pharmaceutical blisters (145) formed therein. Each of the pharmaceutical blisters (145) is configured to receive one or more pharmaceutical products (410) such as tablets, capsules, or the like.

Additionally, as illustrated in FIG. 4, the pharmaceutical blister pack (140) includes a sacrificial backing sheet or lidding (420) configured to hermetically seal the pharmaceutical blisters (145) until pressure is applied to separate, rupture, or otherwise release the pharmaceutical product (410). According to one exemplary embodiment, the lidding (420) may be made out of any number of easily rupturing materials including, but in no way limited to, foil, perforated plastic, and/or paper based material. As illustrated in FIG. 4, the lidding (420) may be coupled to the plastic blister material (400) in a planar fashion. In other words, a thermally activated, pressure activated, or other adhesive may be applied to the contact surface of the lidding (420) such that, when combined with the pharmaceutical blister pack (140), the lidding linearly spans the gaps created by the pharmaceutical blisters (145) and the structural ribs (300) while adhering to the planar surfaces of the thermoplastic blister material (400). While the present system and method are described in the context of a thermoplastic based pharmaceutical blister pack (140), any generally planar structure for storing and dispensing pharmaceutical products may be incorporated by the present system and method.

FIG. 4 also illustrates a joining interface (310) shared by the tether lip (130) and at least one surface of a pharmaceutical housing, such as a blister pack (140). According to one exemplary embodiment, the tether (120) is formed of high quality paperboard such as paper board of the solid bleached sulfate type, having a thin polymer coating of some kind. Alternatively, the tether (120; FIG. 1) can be formed of any plastic material including, but in no way limited to, poly-vinyl chloride (PVC), poly-vinylidene dichloride (PVdC), Aclar, polypropylene (PP), polyethylene (PE), polyethylene terepthalate glycol (PETG), or any other compatible material that may be ultrasonically welded to a pharmaceutical blister pack (140). It is noted that while a thin polymer coating may be present on the tether (120), an ultrasonic weld may be formed with or without the presence of a coating on the tether.

As illustrated in FIG. 4, when joining a tether lip (130) and a pharmaceutical blister pack (140), the tether lip (130) is superposed adjacent to the pharmaceutical blister pack (140). The combination of the tether (120) coupled to the pharmaceutical blister pack (140) is dimensioned to fit substantially inside the housing (114; FIG. 1) (i.e., smaller than the depth and useable width of the housing). The tether (120) may also include a hinged lip portion to allow the combination of the tether (120) and the blister pack (140) to be more compact. Additionally, the tether (120) can be formed with one or more slots (124; FIG. 1) to allow the tether to be slideably inserted into a housing (114; FIG. 1).

According to one exemplary embodiment, the tether (120) is ultrasonically welded to the structural rib (300) of the pharmaceutical blister pack (140). The rounded surface of the structural rib allows for an increased surface area of the pharmaceutical blister pack (140) to be joined to the tether (120) without sacrificing additional pharmaceutical blister area. Moreover, resilience of the rib/blister pack interface to separation caused by bending is enhanced as the strength of the bond is increased. Additional details of the exemplary coupling method will be described in further detail below with reference to FIGS. 5 through 14.

Figure 5:
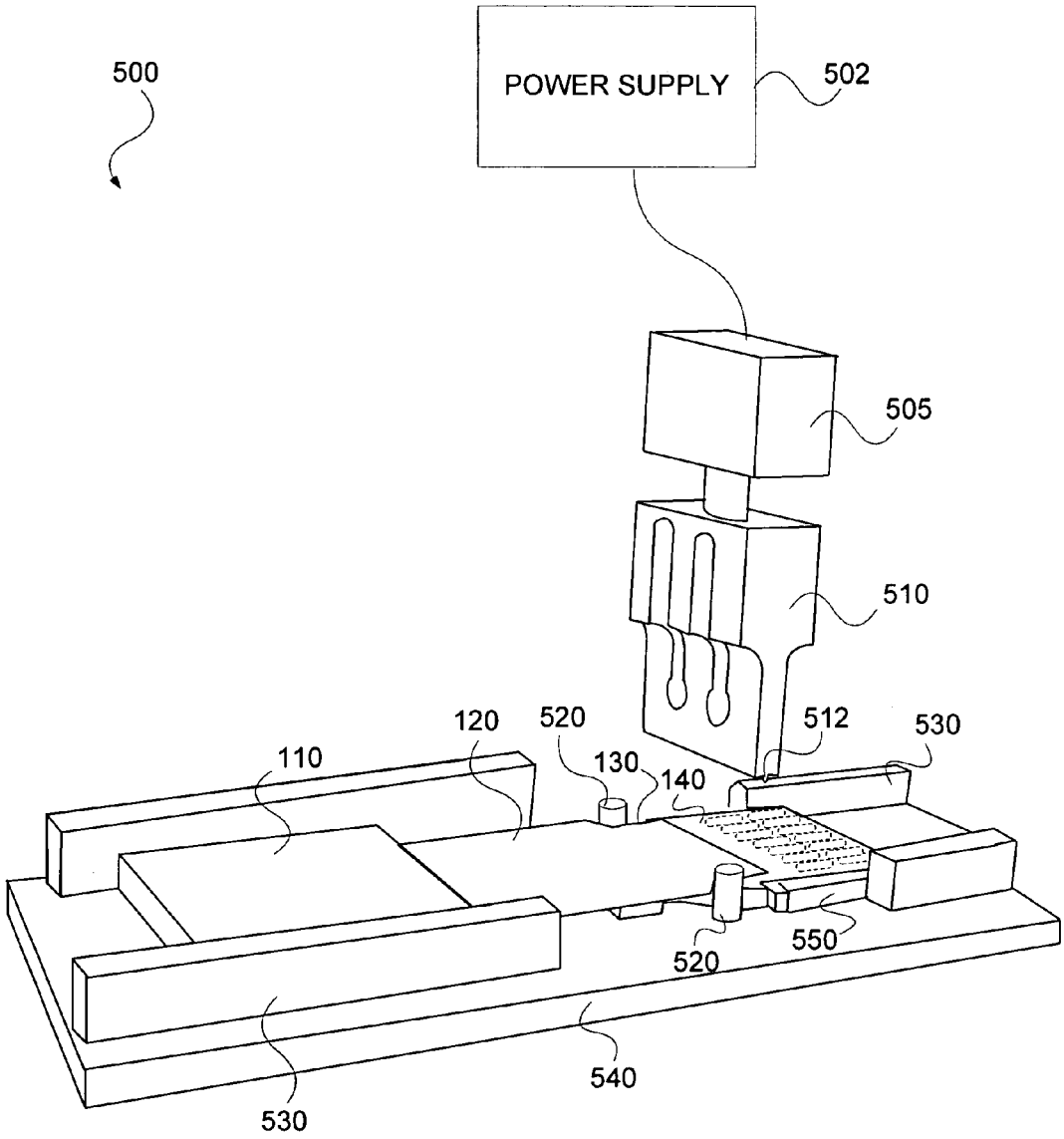
FIG. 5 is a perspective view illustrating an ultrasonic welding apparatus, according to one exemplary embodiment.

FIG. 5 is a perspective view illustrating an ultrasonic welding apparatus configured to securely position and ultrasonically weld a tether (120) to a structural rib (300) of a pharmaceutical blister pack (140), according to one exemplary embodiment. As illustrated in FIG. 5, the first exemplary ultrasonic welding apparatus (500) includes a male transducer horn (510) configured to impart oscillations at ultrasonic frequencies to the joining interface (310; FIG. 3), and a number of positioning components including a female anvil positioned on a bed member (540) disposed adjacent to the male transducer horn.

The male transducer horn (510) illustrated in FIG. 5 may be constructed of any number of materials configured to transfer vibratory energy to a plurality of receiving members including, but in no way limited to, aluminum or titanium. As shown in FIG. 5, the male transducer horn (510) is coupled to a power supply (502) and an amplitude converter/modifier (505). According to one exemplary embodiment, the power supply (502) modifies electricity from a frequency of 50-60 Hz into a high frequency electrical supply operating between approximately 10 and 75 kHz. This electrical energy is supplied to the amplitude converter/modifier (505) where the electrical energy is changed into mechanical vibratory energy at ultrasonic frequencies and amplified. The amplified vibratory energy is then transferred to the male transducer horn (510) where it is focused to the horn extrusion (512), to be applied to the materials being joined. According to the present exemplary embodiment, the horn extrusion (512) of the male transducer horn (510) is designed as the male counterpart of the structural rib (300; FIG. 3).

As illustrated in FIG. 5, the bed member (540) includes a number of alignment components configured to properly and securely align the tether (120) and the pharmaceutical blister pack (140) in preparation of an ultrasonic welding operation. The alignment components disposed on the bed member (540) include, but are in no way limited to, a number of horizontal positioning guides (530) and a plurality of alignment pins (520).

Additionally, FIG. 5 illustrates the components of a child resistant package (100; FIG. 1) disposed within the alignment components (520, 530). As shown, a child resistant shell (110) having a tether (120) coupled thereto is disposed on a first end of the bed member (540). The tether lip portion (130) of the tether (120) is disposed adjacent to the male transducer horn (510). The lateral position of the child resistant shell (110) is assured by one or more positioning guides (530) and both the lateral and horizontal position of the tether are secured by the plurality of alignment pins (520). As shown in FIG. 5, the child resistant shell (110) and the tether (120) coupled thereto are restricted in their lateral and horizontal movement by the positioning guides (530) and the alignment pins (520).

Figure 9:
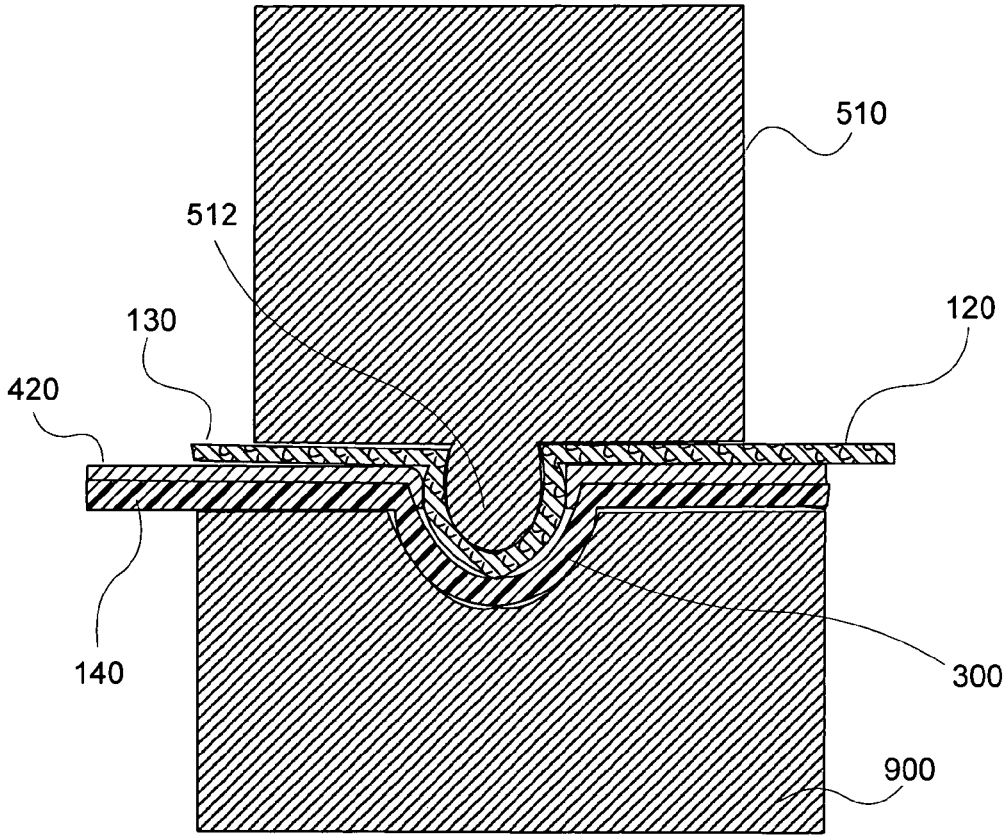
FIG. 9 is a cross-sectional side-view of a pharmaceutical blister pack being welded to a tether, according to one exemplary embodiment.

Additionally, FIG. 5 shows a pharmaceutical blister pack (140) disposed on a second end of the bed member (540). As shown, the pharmaceutical blister pack (140) is disposed with the lidding (420; FIG. 4) side oriented towards the male transducer horn (510), causing the structural rib (300) to appear concave from the perspective of the male transducer horn. Additionally, one edge of the pharmaceutical blister pack (140) is disposed adjacent to the male transducer horn (510), with the tether lip (130) disposed there between. The pharmaceutical blister pack (140) is placed into the anvil (900; FIG. 9) so that it is positioned with the structural rib (300; FIG. 3) in-line with the horn extrusion (512) of the male transducer horn (510). A number of positioning guides (530) align and prevent lateral movement of the pharmaceutical blister pack (140). The overlapping interface between the pharmaceutical blister pack (140) and the tether lip (130) is reinforced by a number of support backing members (550) disposed on the bed member (540). According to one exemplary embodiment, the support backing member (550) includes a sheet of rubberized material having a number of orifices formed therein. The orifices formed in the support backing member (550) are configured to receive the pharmaceutical blisters (145; FIG. 3) of the pharmaceutical blister pack (140). The support backing member (550) may be customized and replaced to correspond with a desired pharmaceutical blister pack (140) configuration.

Figure 6:
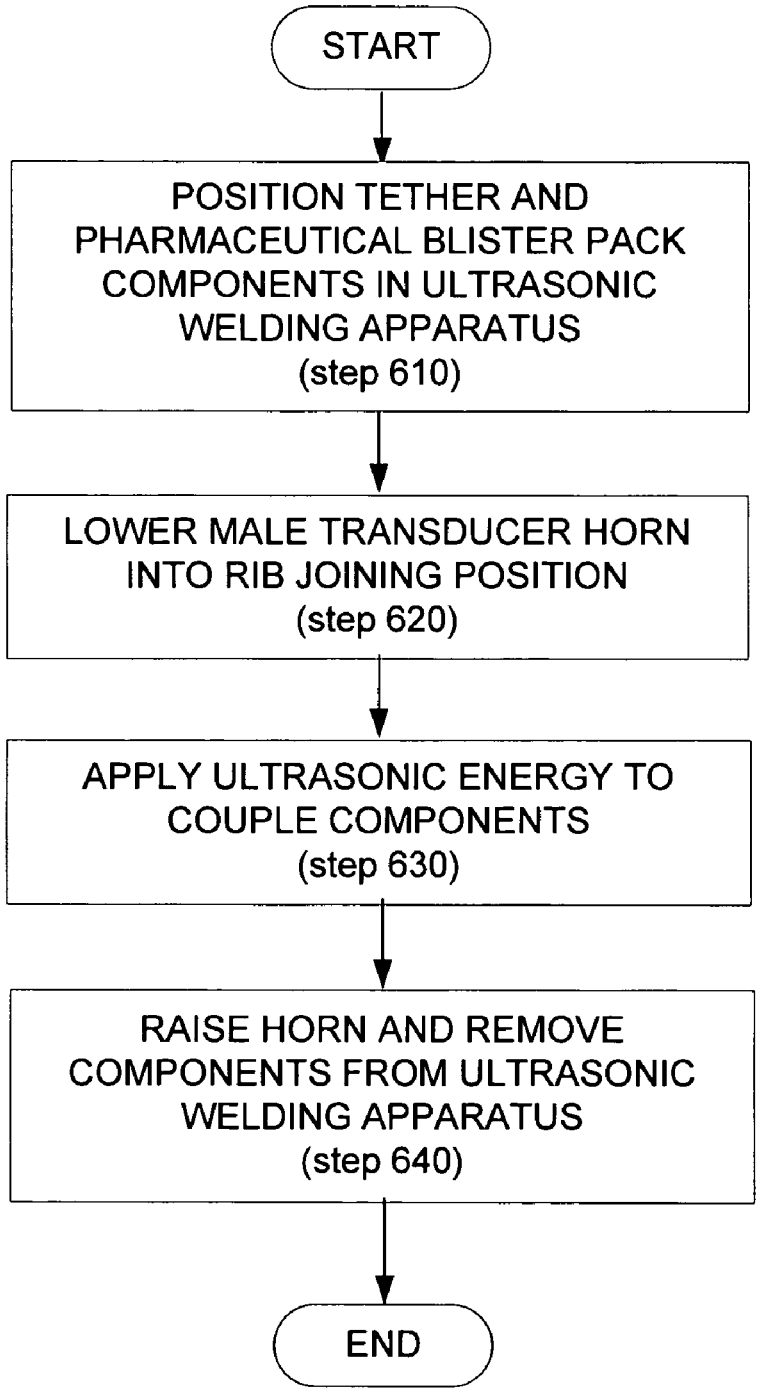
FIG. 6 is a simple flow chart illustrating a method for ultrasonically joining a pharmaceutical blister pack to a hinged tether lip, according to one exemplary embodiment.

FIG. 6 illustrates a method for securely coupling the pharmaceutical blister pack (140; FIG. 5) to a tether lip (130) using the above-mentioned configuration, according to one exemplary embodiment. As illustrated in FIG. 6, the exemplary method begins by first positioning the tether and pharmaceutical blister pack components in the ultrasonic welding apparatus (step 610). Once the components are properly placed in the ultrasonic welding apparatus, the male transducer horn may be lowered into a rib joining position (step 620). Ultrasonic energy may then be transmitted through the male transducer horn (510; FIG. 5) to securely couple the pharmaceutical blister pack and the tether lip (step 630). Once coupled, the horn may be retracted and the ultrasonically welded components may be removed from the ultrasonic welding apparatus (step 640) for use. Further details of the exemplary method illustrated in FIG. 6 will be given below with reference to FIGS. 6 through 11.

Figure 7:
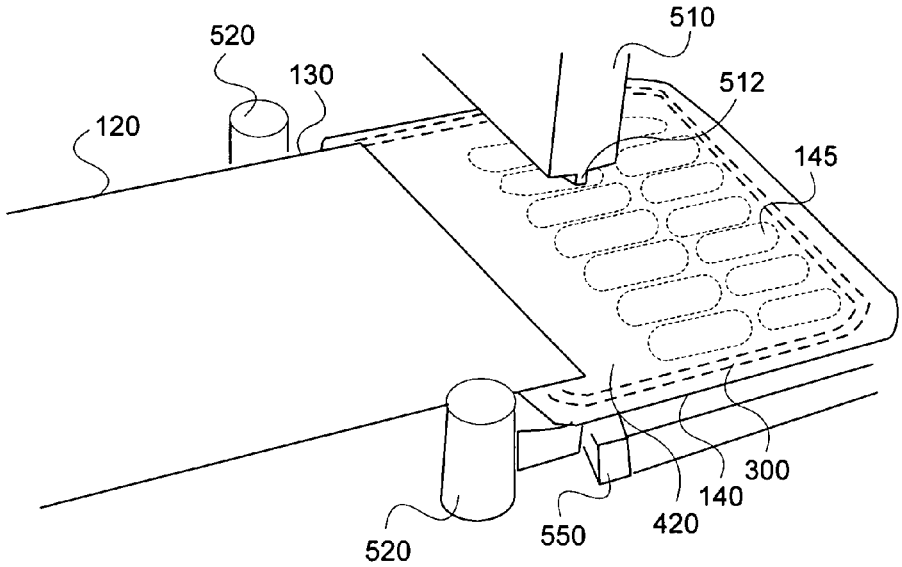
FIG. 7 is a perspective view illustrating a pharmaceutical blister pack and a tether inserted into an ultrasonic welding apparatus, according to one exemplary embodiment.

As described in FIG. 6, the present exemplary method begins by properly positioning the tether and pharmaceutical blister pack components in an ultrasonic welding apparatus (500; FIG. 5). FIG. 7 illustrates a properly positioned tether and pharmaceutical blister pack components disposed in an ultrasonic welding apparatus (500; FIG. 5), according to a first exemplary embodiment. As shown, the tether (120), and consequently, the tether lip (130) portions of the tether are securely positioned adjacent to the male transducer horn (510) by the alignment pins (520). Additionally, as illustrated in FIG. 7, a pharmaceutical blister pack (140) is positioned adjacent to the male horn (510) with the tether lip (130) disposed there between. The orientation of the pharmaceutical blister pack (140) is such that the structural rib (300) of the pharmaceutical blister pack is linearly adjacent to the horn extrusion (512) of the male transducer horn (510) with the lidding surface (420) oriented towards the male transducer horn.

Figure 8:
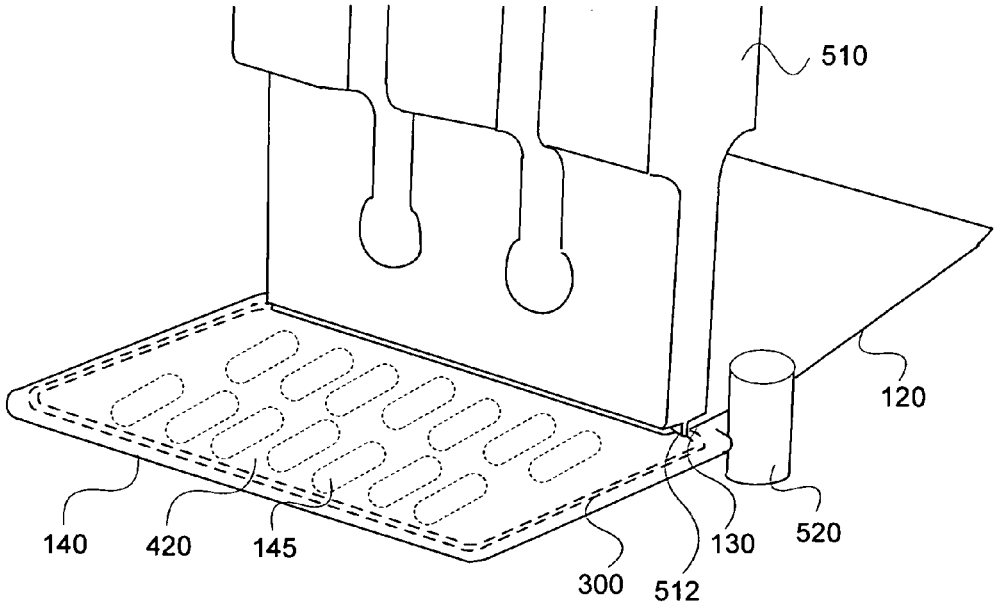
FIG. 8 is a perspective view of an ultrasonic horn coupling a pharmaceutical blister pack to a tether, according to one exemplary embodiment.

Once the components to be joined are correctly positioned, the male transducer horn (510) may be lowered into a sealing position (step 620; FIG. 6), as illustrated in FIG. 8. As shown, the male transducer horn (510) is lowered, inserting the horn extrusion (512) onto the tether lip (130) of the tether (120). As the horn extrusion (512) is extended towards the structural rib (300), the tether lip (130) and the horn extrusion (512) are forced through the lidding (420) of the pharmaceutical blister pack (140) and into the structural rib (300).

FIG. 9 is a cross-sectional view further illustrating the male transducer horn (510) lowered into a rib joining position (step 620; FIG. 6). As shown in FIG. 9, the horn extrusion (512) is designed as the male counterpart of the structural rib (300). Additionally, an anvil (900) is illustrated as the female counterpart of the male transducer horn (510). The anvil (900) is disposed adjacent to the male transducer horn (510) and receives the structural rib (300; FIG. 3) of the pharmaceutical blister pack. During operation, the anvil (900) absorbs or reflects ultrasonic energy that is produced by the male transducer horn (510) to aid in the ultrasonic welding process.

As illustrated in FIG. 9, the horn extrusion (512) may be forced onto the tether (120) such that the tether lip (130) is deformed and forced through the non-joinable lidding (420) of the pharmaceutical blister pack (140). According to one exemplary embodiment, the lidding (420) may be pre-cut at the point of contact with the horn extrusion (512) to further facilitate the passage of the tether lip (130). As illustrated in FIG. 9, the separation of the lidding (420) allows the deformed tether lip (130) to enter the already formed structural rib (300) of the pharmaceutical blister pack (140). Additionally, separation of the lidding (420) allows the ultrasonically weldable tether lip (130) to directly contact the thermoplastic blister material of the structural rib (300). Force from the horn extrusion (512) is sufficient to cause material flow and/or deformation, depending on the material properties of the tether (120), sufficient to cause the tether (120) to enter the structural rib (300). Once inserted into the structural rib (300), the horn extrusion (512) continues to apply pressure, thereby sandwiching the tether lip (130) and the structural rib between the horn extrusion and the anvil (900) as shown in FIG. 9. This configuration provides substantial contact between the tether lip (130) and the structural rib (300).

Once the horn extrusion has been lowered into the sealing position illustrated in FIG. 9, the male transducer horn (510) may be actuated to introduce ultrasonic energy (step 630; FIG. 6) to the tether lip (130) and the structural rib (300). As mentioned previously, ultrasonic energy may be introduced via the male transducer horn (510). The male transducer horn (510) is an acoustic tool that transfers ultrasonic energy directly to the interface of the parts being assembled. As noted above, the frequency of oscillation of the ultrasonic energy generally ranges from 10 kHz to 75 kHz, although both lower and higher frequencies can be employed to correspond to the thickness and hardness of the materials being joined. Additionally, the male transducer horn (510) is configured to apply a welding pressure to the interfacing parts. It is submitted that particular ultrasonic frequency, power levels, pressures, and other operating parameters are well within the grasp of those skilled in the art.

Once the ultrasonic energy is transmitted to the interface of the tether lip (130) and the structural rib (300), the vibratory energy of the male transducer horn (510) is converted into thermal energy through friction. The increase in thermal energy then softens and/or melts the thermoplastic structural rib (300) and the thin layer of polymer coating formed on the tether lip (130). Once softened and/or melted, the ultrasonic vibration is stopped, allowing the molten material to solidify and form a weld. The resulting weld forms a seam permanently joining the pharmaceutical blister pack (140) to the tether (120).

While the present exemplary embodiment has been described in the context of ultrasonically welding a thermoplastic structural rib (300) to a tether (120) having a polymer coating thereon, ultrasonic welding can be used to join any number of materials including, but in no way limited to, plastics, lap weld sheet, foil, and/or thin wire.

Once the weld has been formed within the structural rib (300), the male transducer horn (510) is withdrawn and the ultrasonically welded tether (120) and pharmaceutical blister pack (140) may be removed from the ultrasonic welding apparatus (step 640; FIG. 6).

Figure 10:
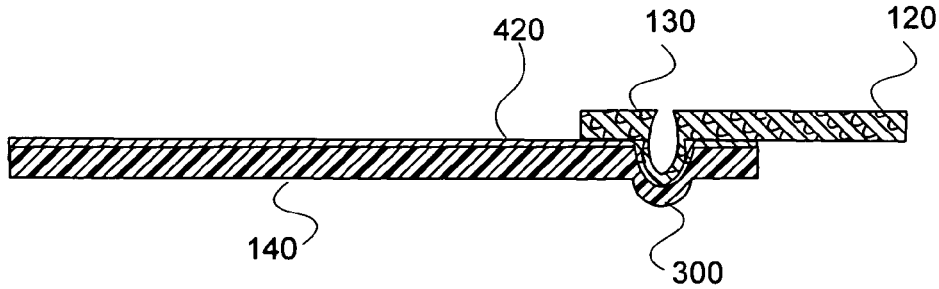
FIG. 10 is a cross-sectional side-view of a pharmaceutical blister pack ultrasonically welded to a tether, according to one exemplary embodiment.

FIG. 10 is a side cross-sectional view illustrating the ultrasonically joined tether (120) and pharmaceutical blister pack (140). As illustrated, the tether (120) is deformed to the shape of the structural rib (300), allowing the outer surface of the tether lip (130) to be joined to the inside surface of the structural rib. Consequently, the traditional flat-face to flat-face ultrasonic weld is avoided and the resistance of the weld to bending is enhanced. By joining the outer surface of the tether lip (130), to the inside surface of the structural rib (300), mechanical advantage is resisted by the structural rib (300). Additionally, the rounded surface of the structural rib allows for an increased surface area of the pharmaceutical blister pack (140) to be joined to the tether lip (130) without sacrificing additional pharmaceutical space.

Figure 11A:
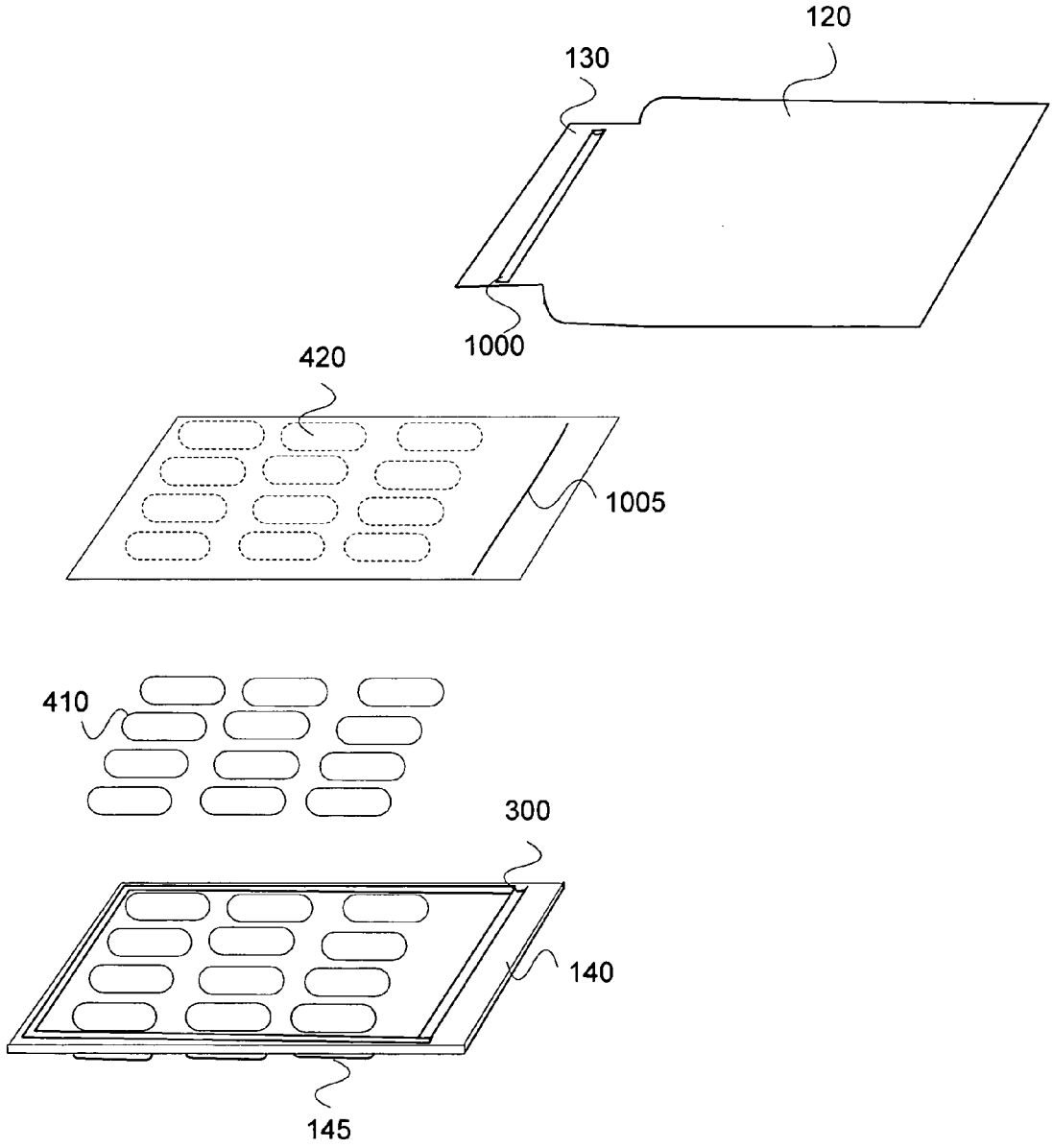
FIG. 11A is an exploded component view of a pharmaceutical blister pack ultrasonically welded to a tether, according to one exemplary embodiment.

FIG. 11A is an exploded component view illustrating the components of a joined pharmaceutical blister pack (140) and tether (120). As illustrated in FIG. 11A, the above-mentioned method forms a welded groove (1000) in the tether lip (130). Additionally, a separated section (1005) of the lidding (420) corresponds to the location where the welded groove passes through the lidding into the structural rib (300) of the pharmaceutical blister pack (140).

Figure 11B:
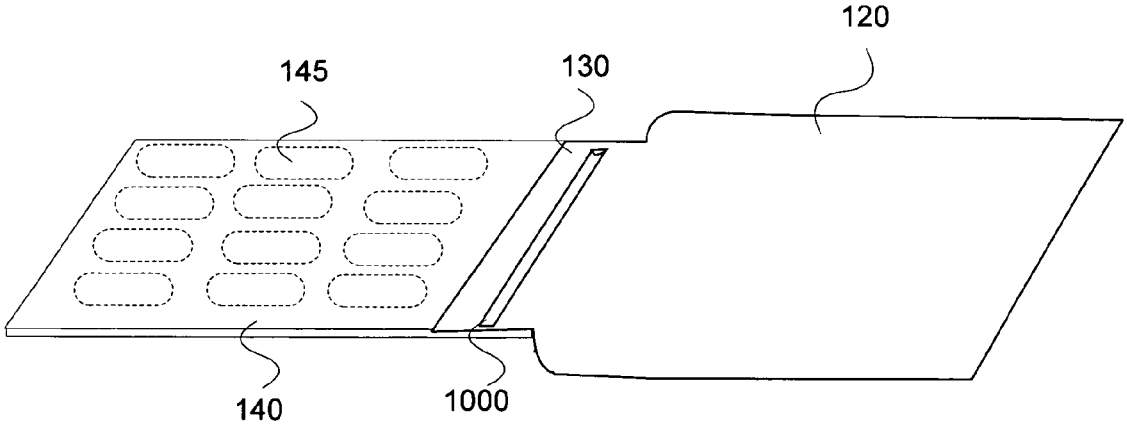
FIG. 11B is a perspective view illustrating a pharmaceutical blister pack ultrasonically welded to a tether, according to one exemplary embodiment.

FIG. 11B further illustrates a perspective view showing an ultrasonically welded tether (120) and pharmaceutical blister pack (140). As illustrated in FIG. 11B, the ultrasonic welding process described above welds the tether lip (130) of the tether (120) to the inside of the structural rib (300; FIG. 9), leaving a welded groove (1000) on the back of the tether lip (130).

In addition to joining the above-mentioned thermoplastic blister materials, the present method allows for the joining of various pharmaceutical blister pack forming materials. The ultrasonic welding process is advantageous because it is both reliable and versatile. It can be used with a wide variety of metallic and non-metallic materials, including dissimilar metals (bimetallic strips). Ultrasonic welding can be used to join packaging materials including, but in no way limited to, plastics, lap weld sheet, foil, and/or thin wire.

Moreover, unlike traditional joining methods, the above-mentioned blister joining method is not limited by the surface materials of the pharmaceutical blister packs (140). That is, traditional joining methods did not allow pharmaceutical blister packs having non-weldable surface materials, such as nylon or foil, to be joined to a tether (120) because of the incompatibility of the surface materials. However, the present systems and methods allow the tether (120) to pass through the foil lidding and be joined to the inner surface of the structural rib (300). Consequently, a joinable material, such as polyvinylchloride (PVC) for example, may be included inside the structural rib (300) of the pharmaceutical blister pack (140), to allow for ultrasonic welding, while the outside surface of the pharmaceutical blister packs remains coated in a desirable non-joinable material.

While the present ultrasonic welding system and method have been described in the context of using a simple ultrasonic welding apparatus (500), a number of modifications may be made to the system. According to one exemplary embodiment, the joining method may be fully automated to an assembly line production.

Figure 12:
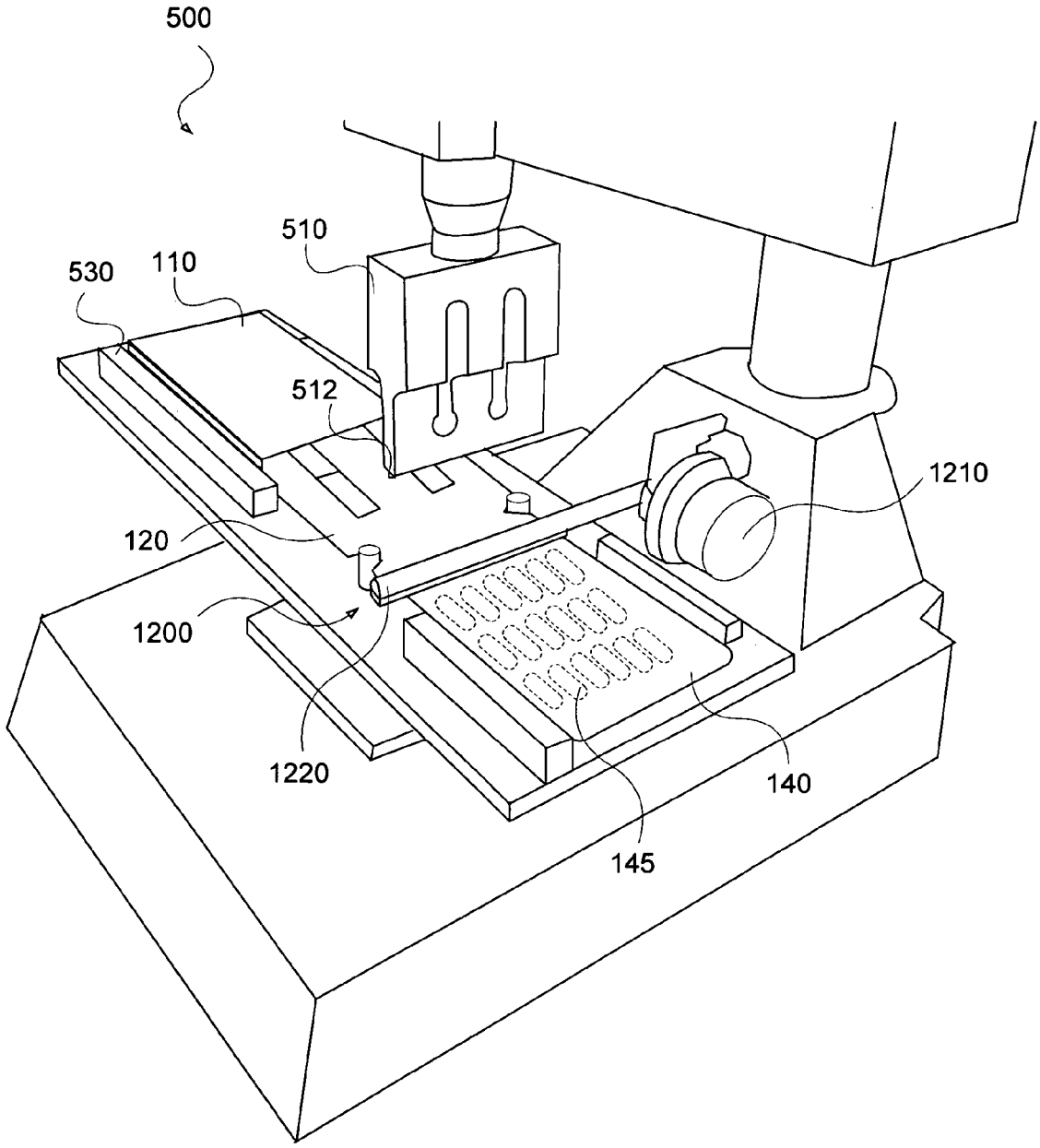
FIG. 12 is a perspective view illustrating an ultrasonic welding apparatus, according to a second exemplary embodiment.
Figure 13:
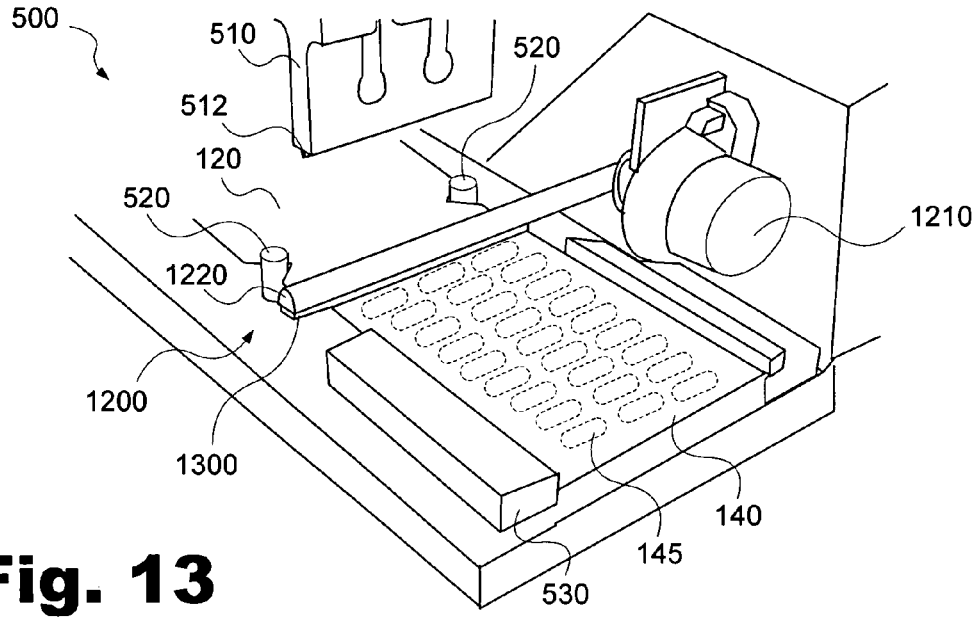
FIG. 13 is a perspective view of an ultrasonic welding apparatus, according to a second exemplary embodiment.
Figure 14:
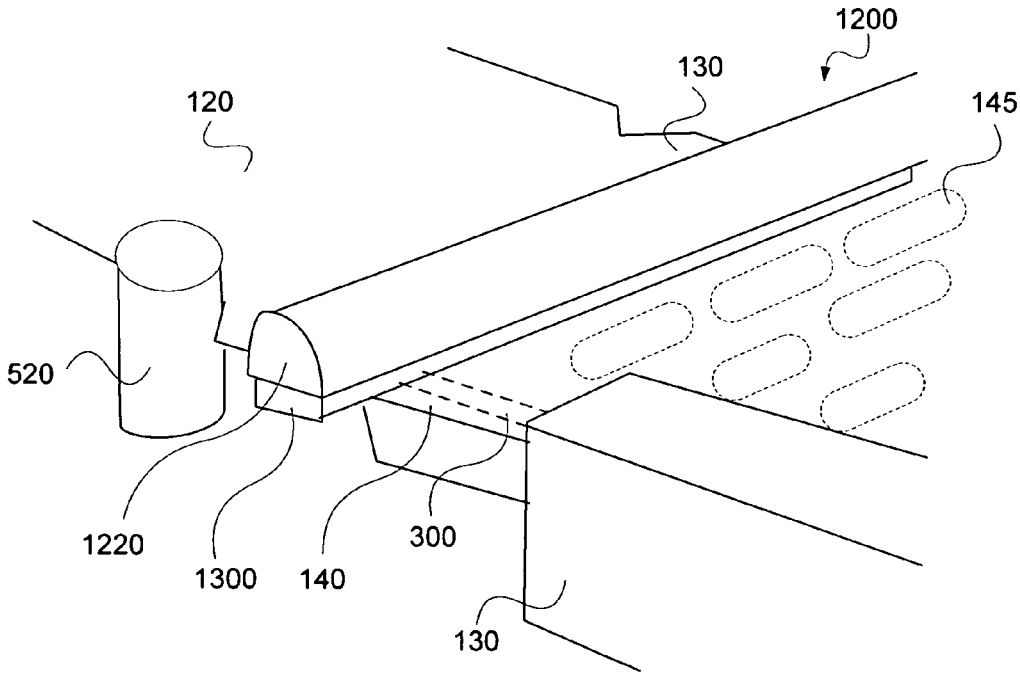
FIG. 14 is a magnified perspective view of an ultrasonic welding apparatus, according to a second exemplary embodiment.

Additionally, as illustrated in FIG. 12, additional functional components such as a dampening mechanism (1200) may be added to the ultrasonic welding apparatus (500) to prevent vibratory energy exerted by the male transducer horn (512; FIG. 12) from being transferred to the entire pharmaceutical blister pack (140). As shown in FIG. 12, a dampening mechanism (1200), including a dampening arm (1220) and a dampening control (1210), is added to the ultrasonic welding apparatus (500) to further enhance the joining method. As shown in FIGS. 13 and 14, the dampening mechanism (1200) may include a dampening rubber surface (1300) that is selectively disposed on the pharmaceutical blister pack (140) near the interface between the hinged tether lip (520) and the pharmaceutical blister pack (140). According to the exemplary embodiment illustrated in FIG. 13, the dampening mechanism (1200) may be controlled, by the dampening control (1210), to vary the downward pressure exerted by the dampening rubber surface (1300) on the pharmaceutical blister pack (140). The exertion of pressure by the dampening mechanism (1200) will not only restrict the transfer of ultrasonic energy throughout the pharmaceutical blister pack (140), thereby focusing the application of ultrasonic energy to the interface between the hinged tether lip (520) and the pharmaceutical blister pack (140), but it will also aid in securing the position of the pharmaceutical blister pack during the ultrasonic joining operations.

As illustrated above, the ultrasonic joining methods are independent of the type of tether being joined to the pharmaceutical blister pack. Consequently, in contrast to traditional systems and methods, the present system and method may be incorporated to quickly adapt an existing pharmaceutical blister pack to be compatible with a newly designed packaging configuration without additional re-tooling. Rather, a new tether corresponding with the new desired packaging is merely coupled to the pharmaceutical blister using the above-mentioned systems and methods. As a result, a single pharmaceutical blister pack may be coupled to any number of tether and/or packaging types including, but in no way limited to, those manufactured by WESTVACO, RONDO, DIVIDELLA, and/or STORAENSO.

While the above-mentioned exemplary embodiments have been described in the context of joining a pharmaceutical blister pack to a tether, the present systems and methods may be used to ultrasonically weld any number of blister packs or other housings having a structural rib to a tether. Consequently, the present systems and methods may be used to couple a tether to blister packs containing items such as, but in no way limited to, sterile instruments, electronics, and/or contact lenses.

In conclusion, the present systems and methods for ultrasonically welding a tether to a blister pack increase the strength and surface area of the joint without sacrificing valuable blister pack surface area. By increasing the strength of the joint, the present systems and methods enhance the safety features of child resistant packaging and assure continual coupling of a desired tether to a blister pack. More specifically, the present systems and methods may be used to secure a pharmaceutical housing to a tether, such as that of a child resistant packaging, so that the coupling is not susceptible to separation due to light bending.

The preceding description has been presented only to illustrate and describe exemplary embodiments of the present systems and methods. It is not intended to be exhaustive or to limit the systems and methods to any precise form disclosed. Many modifications and variations are possible in light of the above teaching. It is intended that the scope of the systems and methods be defined by the following claims.

What is claimed is:

1. A blister pack comprising:

a blister card including one or more cavities and a rib formed in said blister card, said rib having an inner surface bounding a recessed channel;

a lidding member coupled to said blister card, said lidding member hermetically sealing said one or more cavities; and a tether coupled to said blister card so that a portion of said tether is disposed within said recessed channel of said rib, said portion of said tether projecting through said lidding member and being secured to said inner surface of said rib by an ultrasonic weld.

2. The blister pack of claim 1, wherein said lidding member comprises one of a foil, a plastic, or a paper.

3. The blister pack of claim 1, wherein said lidding member further comprises a separated section; said portion of said tether projecting through said lidding member at said separated section.

4. The blister pack of claim 1, wherein said rib comprises a structural rib configured to prevent curling of said blister card.

5. The blister pack of claim 1, wherein said one or more cavities are configured to house one of a pharmaceutical, a sterilized instrument, an electronic component, or a contact lens.

6. The blister pack of claim 1, wherein said blister card comprises one of a thermoplastic, a nylon, or a foil.

7. The blister pack of claim 1, wherein said tether comprises one of a paper board having a polymer coating, a poly-vinyl chloride (PVC), a poly-vinylidene dichloride (PVdC), Aclar, polypropylene (PP), polyethylene terepthalate glycol (PETG), or polyethylene (PE).

8. The blister pack of claim 1, wherein said tether is coupled to a child resistant package.

9. The blister pack of claim 1, further comprising a pharmaceutical housed within said one or more cavities.

10. A pharmaceutical package comprising:

a blister card including one or more cavities configured to house a pharmaceutical and a structural rib formed in said blister card, said structural rib including an inner surface;

a lidding coupled to said blister card, said lidding being configured to hermetically seal said one or more cavities; and a tether coupled to the inner surface of said structural rib, said tether being coupled to the inner surface of said structural rib by an ultrasonic weld, wherein said tether projects through said lidding when coupling said tether to said structural rib.

11. The pharmaceutical package of claim 10, wherein said lidding comprises one of a foil, a plastic, or a paper.

12. The pharmaceutical package of claim 10, wherein said blister card comprises one of a thermoplastic, a nylon, or a foil.

13. The pharmaceutical package of claim 10, wherein said tether comprises a paperboard including a polymer coating.

14. The pharmaceutical package of claim 10, wherein said tether comprises one of a poly-vinyl chloride (PVC), a poly-vinylidene dichloride (PVdC), Aclar, polypropylene (PP), polyethylene terepthalate glycol (PETG), or polyethylene (PE).

15. The pharmaceutical package of claim 10, wherein said tether is coupled to a child resistant package.

16. The pharmaceutical package of claim 10, wherein said inner surface of said structural rib bounds a recessed channel, a portion of the tether coupled to the inner surface of said structural rib being disposed within the channel.

17. The pharmaceutical package of claim 10, further comprising a pharmaceutical housed within said one or more cavities.

18. A pharmaceutical package comprising:

a blister card including one or more cavities configured to house a pharmaceutical and a structural rib formed in said blister card, said structural rib including an inner surface;

a lidding coupled to said blister card, said lidding being configured to hermetically seal said one or more cavities; and a tether coupled to the inner surface of said structural rib, said tether being coupled to the inner surface of said structural rib by an ultrasonic weld, wherein said lidding defines a separated section and said tether projects through said lidding at said separated section.

19. A pharmaceutical package comprising:

a blister card including one or more cavities configured to house a pharmaceutical and a structural rib formed in said blister card, said structural rib including an inner surface;

a lidding coupled to said blister card, said lidding being configured to hermetically seal said one or more cavities; and a tether coupled to the inner surface of said structural rib, wherein said tether projects through said lidding when coupling said tether to said structural rib.

20. The pharmaceutical package of claim 19, wherein said lidding comprises one of a foil, a plastic, or a paper.

21. The pharmaceutical package of claim 19, wherein said blister card comprises one of a thermoplastic, a nylon, or a foil.

22. The pharmaceutical package of claim 19, wherein said tether comprises a paperboard including a polymer coating.

23. The pharmaceutical package of claim 19, wherein said tether comprises one of a poly-vinyl chloride (PVC), a poly-vinylidene dichloride (PVdC), Aclar, polypropylene (PP), polyethylene terepthalate glycol (PETG), or polyethylene (PE).

24. A blister pack comprising:

a blister card including one or more cavities and a rib formed in said blister card, said rib having an inner surface bounding a recessed channel;

a lidding member coupled to said blister card, said lidding member hermetically sealing said one or more cavities; and a tether coupled to said blister card so that a portion of said tether projects through said lidding member and is disposed within said recessed channel of said rib, said portion of said tether being secured to said inner surface of said rib.

25. The blister pack of claim 24, wherein said lidding member comprises a separated section such that said portion of said tether projects through said lidding member at said separated section.

* * * * *